United States Patent [19]

Marco

[11] Patent Number: 4,474,305

[45] Date of Patent: Oct. 2, 1984

[54] TAMPER-EVIDENT CONTAINER

[75] Inventor: Leslie S. Marco, Bloomingdale, Ill.

[73] Assignee: Illinois Tool Works Inc., Chicago, Ill.

[21] Appl. No.: 502,982

[22] Filed: Jun. 10, 1983

[51] Int. Cl.[3] ..... B65D 39/00

[52] U.S. Cl. ..... 220/307; 220/284

[58] Field of Search ..... 220/284, 306, 307, 270; 150/5, 276

[56] References Cited

U.S. PATENT DOCUMENTS 4,006,839 2/1977 Thiel et al. ..... 220/307

4,385,711 5/1983 Bowen ..... 220/284

*Primary Examiner*—George T. Hall

*Attorney, Agent, or Firm*—Thomas Buckman

[57] ABSTRACT

A tamper-evident container is supplied which has internal ribs adjacent the upper rim. The rim is provided with an external upwardly opening trough. A lid for the container has portions interfitting with the ribs to secure the lid in place. A portion of the lid overlies the upper rim of the container, and a depending skirt on the lid extends down into the trough about the upper end of the container whereby the skirt is initially hidden and protected against lifting thereof to remove the lid. The upper outer edge of the trough is provided with weakened areas including notches and, optionally indentations below the notches to facilitate tearing of the trough wall in the direction of plastic grain of the container. Such tearing of the wall permits lifting of the lid skirt to remove the lid, and provides a quick visual check that the container has been tampered with.

10 Claims, 5 Drawing Figures

FIG. 1
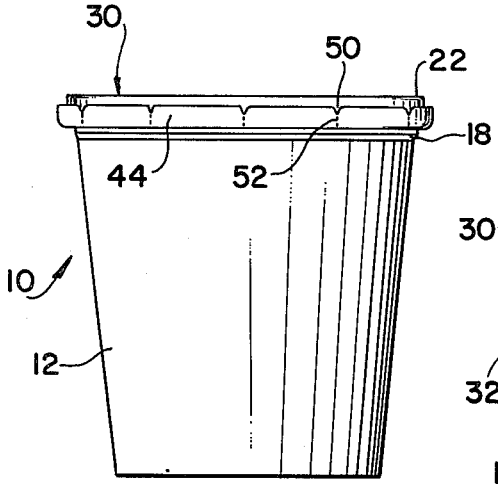
FIG. 2
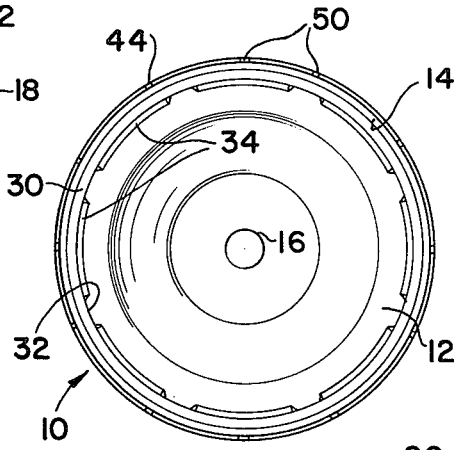
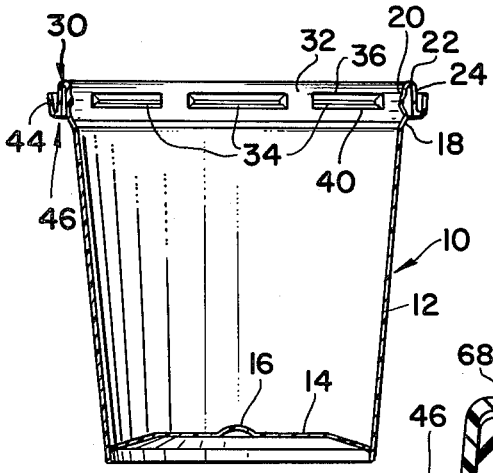
FIG. 3
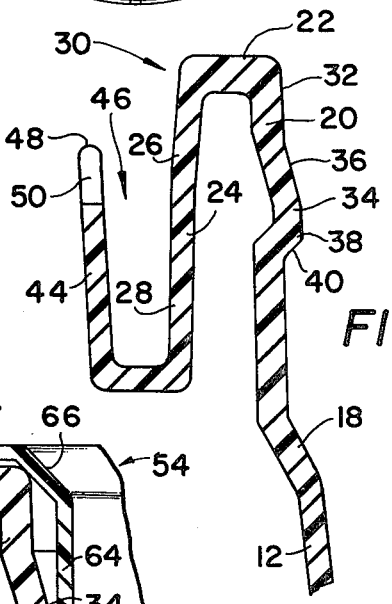
FIG. 4
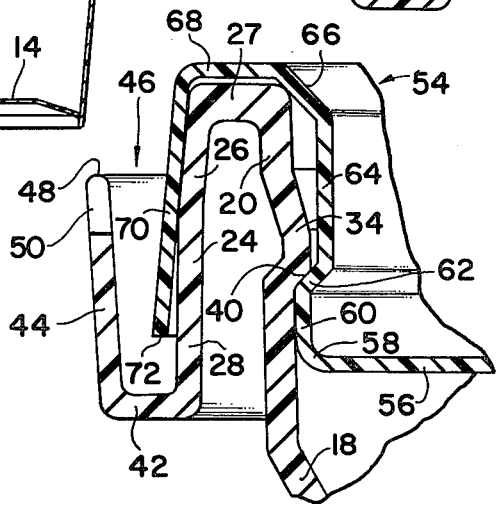
FIG. 5

TAMPER-EVIDENT CONTAINER

BACKGROUND OF THE INVENTION

It is common practice to package many items, particularly dairy food items, in plastic containers in the form of cups or tubs having a sealing lid thereon. The lid is associated with the container in such manner that the lid can be removed for removal of some or all of the contents of the container. In the event that all of the contents are not removed, then the lid is capable of being reinstalled on the container for storage of the contents.

Unfortunately, some shoppers are quite inconsiderate of the rights of other shoppers and of the store in which goods are sold. Some shoppers will remove the lid of the container to smell or sample the contents, and then replace the lid on the container and return the container to its sale position. Such opening and reclosing of the container, particularly if a part of the contents is removed, raises a serious question of contamination of the contents, and also may result in short weight being given to the ultimate consumer. If sufficient of the contents has been removed a subsequent would be purchaser is likely to notice the short weight, but customers are not accustomed to having to estimate by weight whether a container is full, and customers should not have to do this.

Accordingly, various efforts have been made to produce a more or less tamper proof container assembly. Some such efforts have involved the adhering or welding of container and lid together. This is undesirable in that it requires special and expensive machinery for securing the parts together. Furthermore, opening of such packages can be difficult and may result in tearing of a portion of a container, thereby rendering it essentially useless for subsequent storage. Other efforts to produce tamper proof containers have produced interengageable parts of containers and lids which overlap to the point that the lid cannot be properly engaged for removal without first tearing off a portion of the interengageable structure. With a portion so torn off a simple visual inspection reveals that there has been tapering with the container.

OBJECTS AND SUMMARY OF THE PRESENT INVENTION

The broad object of the present invention is to provide a plastic container having a removable lid interfitted with the container in such manner that any tampering is immediately visually evident.

More particularly, it is an object of the present invention to provide a tamper evident container and lid in which the lid is substantially thinner than the container which, coupled with particular taper angles of the container and lid, prevents manipulation of the exposed area of the lid to effect lifting thereof.

A further object of the present invention is to provide a tamper evident container in which fracturing of a portion of the container for removal of the lid is more readily effected than in the prior art.

In attaining the foregoing and other advantages of the present invention a thermoformed container of plastic material is provided with a downturned upper rim which merges into a re-entrant trough. The lid interfits with the upper part of the container and has a depending rim received in the trough in protected position where it cannot be engaged by the fingers for lifting and removal of the lid. The upturned edge of the trough is provided with arcuately spaced notches and/or score lines. Thermoforming of containers inherently produces a grain orientation in the direction of stretch, i.e., axially of the container. Since the notches and/or score lines run axially of the rim it is far easier to fracture the material than it would be if it were necessary to fracture the plastic material transversely of the grain orientation as is the case in some prior art. It is only necessary to fracture the rim or lip of the trough, and not to remove a portion thereof, whereby the is no scrap that must be disposed of.

The material of which the lid is formed is substantially thinner than the material of the container, and a particular taper exists in the upper portion of the container and in adjacent portions of the lid to prevent manipulation of the lid to remove it.

DRAWING DESCRIPTION

The invention will best be understood from the ensuing detailed disclosure of the illustrative embodiment when taken in connection with the accompanying drawings wherein:

FIG. 1 is a side view of a container constructed in accordance with the present invention;

FIG. 2 is a top view thereof;

FIG. 3 is an axial sectional view through the container;

FIG. 4 is a fragmentary sectional view on an enlarged scale of the upper portion of the container; and FIG. 5 is similar to FIG. 4 but with the addition of the lid.

DETAILED DISCLOSURE OF THE ILLUSTRATIVE EMBODIMENT

Turning now in greater particularity to the drawings, there will be seen a container 10 in the form of an open mouth cup which has been thermoformed of a suitable plastic material. Polystyrene is one satisfactory material. The cup includes a frusto-conical sidewall 12; The cup is closed at the bottom by an integral bottom wall 4 which is inset slightly from the bottom edge of the sidewall 12 and which is downwardly dished, including a downwardly concave impression 16 in the center. The insetting of the bottom wall and the downward dishing thereof provides greater strength and rigidity for resisting sagging under the weight of the contents of the cup. The specific bottom design is not a feature of the present invention, and the specific bottom wall is exemplary only.

The sidewall 12 tapers upwardly and outwardly from the bottom margin thereof and is provided adjacent the upper edge with a diagonal offset 18 for providing a degree of stiffness to the upper portion of the wall. Upwardly of the offset the wall continues to taper outwardly at 20 to an upper margin 22 where it is offset and turned outwardly and downwardly at 24. As may be seen best in FIGS. 4 and 5 the depending portion 24 of the rim comprises a first or upper portion 26 which tapers downwardly and outwardly and connects to a lower portion 28 which extends straight down. The aforesaid parts 20, 22 and 24 form a rim 30 at the top or open mouth 32 of the cup-shaped container 10. The upper wall portion 20 is provided with a plurality of inwardly projecting arcuate ribs 34 equally arcuately spaced thereabout. In the illustrative example there are eight such ribs, and the ribs are of greater arcuate extent than are the spaces between them. Each rib has a relatively shallow taper 36 at the upper portion to facilitate the assembling of a cup lid therewith. An elongated portion 38 is generally parallel to the inner surface of the upper portion 20 and joins the upper shallow incline or taper 36 to a relatively more abrupt taper 40 forming a shoulder on the underside of the rib to secure a cup lid in place.

At the bottom of the depending portion or wall 28 there is a circumferentially outwardly extending wall 42 which is upturned to form a flange 44 diverging at substantially the same angle as the cup sidewall 12. The wall 24 along with the bottom wall 42 and the flange 44 will be seen to form a trough 46. The upper edge 48 of the flange 44 is provided with a plurality of equally arcuately spaced notches 50 of triangular nature, being of maximum arcuate extent at the top edge 48 and tapering inwardly to an apex. The material of the flange 44 downwardly from each apex is scored or otherwise weakened as indicated by the broken lines 52. In one specific example of the present invention there are eight such notches and weakened lines, although this number is subject to variation. By way of example, there are also eight ribs 34, but this number also is subject to variation.

A lid 54 is provided (FIG. 5) for closing the top of the container and comprises a substantially flat wall or diaphragm 56 spanning the top of the container. The diaphragm is rounded up at 58 to a short cylindrical wall 60 fitting against the container wall 20 beneath the ribs 34. A short oblique inset wall 62 leads from the top of the cylindrical wall to a higher cylindrical wall 64 of slightly less diameter than the inside diameter defined by the ribs 34. The lid then angles obliquely outward at 66 to a horizontal ring or wall 68 having at its outer edge a depending skirt 70.

As will be seen in FIG. 5 the cylindrical wall 60 and diagonal or oblique wall 62 snap beneath the ribs 34, and particularly the oblique surface 40 thereof, the wall 60 forming a snug fit with the adjacent portion of the container wall 20. This provides an effective seal for the open upper end of the container with the diaphragm wall 56 spanning the contents of the container. The oblique wall 66 rests on the corner between the wall 20 and the top edge of the rim 22, while the depending skirt 70 forms a snug fit with the upper wall portion 26 of the container rim. The bottom edge 72 of the skirt 70 terminates above the bottom of the trough 42 in a position where it cannot be reached for removal of the lid other than by fracturing the trough wall 44. The notches 50 and the preferably weakened areas 52 permit such fracturing readily by forcing a portion of the wall 44 outwardly. Further portions may be forced outwardly to cause other fractures if desired. The fracturing is augmented by the fact that the notches and the weakened areas 52 run in the direction of the grain of the plastic rather than transversely thereof. It will be noted that the thickness of the cap material is considerably less than that of the container. The snug interfit of the cap skirt 70 in the upper wall portion 26 and the angulation thereof prevent manipulation of the exposed upper, outer portion of the lid by inward pressure thereof. It will be appreciated that if there is a possibility of relative movement of the lid to the upper margin of the cup there is a potential that the lid could be removed without fracturing the wall 44.

The fact that the lower edge 72 of the lid skirt 70 lies somewhat above the bottom of the trough 46 makes it easier to engage this bottom edge once a portion of the wall 44 has been fractured. Once a portion of the wall has been fractured and bent outwards it provides a quick visual check of the integrity of the package and the tampering can be readily noted. Detection of tampering is particularly important when the container is filled with a dairy product, such as cottage cheese or yogurt, although it is important in all cases. The container is capable of being built in a large range of sizes. One specific container constructed in accordance with the present invention has a maximum vertical dimension of about 3¼ inches, and a maximum horizontal dimension including the trough of about 3¼ inches.

The specific example of the invention as herein shown and described is for illustrative purposes only. Various changes in structure will no doubt occur to those skilled in the art, and will be understood as forming a part of the present invention insofar as they fall within the spirit and scope of the appended claims.

The invention is claimed as follows:

1. A plastic container assembly including a body portion having an open upper end defined by a generally vertical inner wall and an outer depending generally vertical wall joined to the inner wall by a top wall portion, said outer wall having a lower portion joined to an upwardly directed substantially imperforate outer flange, said flange and said outer wall forming an upwardly opening trough and said flange having a free upper edge, and a lid closing the upper end of said body portion and having spaced inner and outer walls interconnected by a top cover flange, said lid outer wall having a free lower edge, said inner walls of said container and said lid being formed to cooperate in a manually releasable interlocking fit, said outer depending wall of said lid depending into said upwardly opening trough, said substantially imperforate outer flange substantially preventing access by a person's finger to the free lower edge of said lid outer wall, and means for weakening the upwardly directed outer flange adjacent the free edge for fracturing of said flange to allow finger access to said lid outer wall free lower edge for removal of said lid.

2. A plastic container assembly as set forth in claim 1 wherein said weakening means comprises a plurality of weakening means spaced along said upwardly directed outer flange.

3. A plastic container assembly as set forth in claim 1 wherein said weakening means comprises an upwardly opening notch in the free edge of said outer flange.

4. A plastic container assembly as set forth in claim 2 wherein each of said weakening means comprises an upwardly opening notch in the free edge of said outer flange.

5. A plastic container assembly as set forth in claim 1 wherein said weakening means comprises a score line.

6. A plastic container assembly as set forth in claim 2 wherein each weakening means comprises a score line.

7. A plastic container assembly as set forth in claim 1 wherein the weakening means comprises an upwardly opening notch in the free edge of said outer flange and a score line leading into said flange from said notch.

8. A plastic container assembly as set forth in claim 2 wherein each weakening means comprises an upwardly opening notch in the free edge of said outer flange and a score line leading into said flange from said notch.

9. A plastic container assembly as set forth in claim 1 wherein the plastic grain orientation of said outer flange is substantially vertical and said weakening means leads vertically into said flange.

10. A plastic container assembly as set forth in claim 1 wherein said lid is substantially thinner than said container, and wherein the container outer wall and the lid outer wall intefit closely and are angled downwardly and outwardly relative to the vertical.

* * * * *